US006508882B1

(12) United States Patent
Zeiffer et al.

(10) Patent No.: US 6,508,882 B1
(45) Date of Patent: Jan. 21, 2003

(54) APPARATUS FOR APPLYING A CHEMICAL FOAM TO A TRAVELING SUBSTRATE

(75) Inventors: Dieter Friedrich Zeiffer, Iron Station, NC (US); Jerry Dean Morgan, Mt. Holly, NC (US); Christoph Walter Aurich, Clemson, SC (US)

(73) Assignee: Gaston Systems, Inc., Stanley, NC (US)

( * ) Notice: Subject to any disclaimer, the term of this patent is extended or adjusted under 35 U.S.C. 154(b) by 0 days.

(21) Appl. No.: 09/577,541

(22) Filed: May 24, 2000

(51) Int. Cl.[7] ..... B05C 11/00
(52) U.S. Cl. ..... 118/684; 118/410
(58) Field of Search ..... 239/574, 143, 239/124, 127; 118/684, 410, 603, 602, 600, 612, 325, 300

(56) References Cited

U.S. PATENT DOCUMENTS 4,237,818 A 12/1980 Clifford et al.
4,402,200 A 9/1983 Clifford et al.
4,655,056 A 4/1987 Zeiffer

*Primary Examiner*—Brenda A. Lamb

(74) *Attorney, Agent, or Firm*—Kennedy Covington Lobdell & Hickman, LLP

(57) ABSTRACT

An apparatus for applying a chemical foam to a traveling substrate in which a plurality of shut-off valves are spaced along a foam conduit between a foam generator and an applicator head to form the conduit into isolated sections when the valves are simultaneously closed upon stoppage of the traveling substrate, thereby maintaining pressure differential along the length of the conduit in readiness for resumption of operation when the substrate resumes travel and the valves are opened. To avoid decomposition of the foam in the applicator head during stoppage, a small by-pass conduit is connected to the valved conduit upstream and downstream of the valves to allow a small quantity of foam to continue to flow to the applicator head during stoppage of the substrate. A discharge valve at a discharge outlet of the applicator head opens during substrate stoppage to allow foam to discharge from the applicator head and maintain circulation of foam therein. The discharged foam is either returned directly to the generator for recycling or is fed selectively to one or the other of a pair of settling tanks until that settling tank is full, at which time the foam is directed to the other settling tank and the foam in the first settling tank is allowed to decompose to a liquid, following which it is recycled to the generator for regeneration and recycling through the apparatus.

12 Claims, 2 Drawing Sheets

APPARATUS FOR APPLYING A CHEMICAL FOAM TO A TRAVELING SUBSTRATE

FIELD OF THE INVENTION

The present invention relates to an apparatus for applying a chemical foam to a traveling substrate, and more particularly to such an apparatus that minimizes fluctuations in the application upon startup following a stoppage of the traveling substrate.

BACKGROUND OF THE INVENTION

Chemicals are commonly applied to traveling substrates in the form of a foam medium to obtain uniform dispersion of a thin application of the chemical. For example, dyestuff, sizeing, and various treating chemicals are applied to textile fabrics of various sorts. To obtain uniform distribution across the traveling substrate and to obtain desired penetration, the foam is normally applied under pressure to the substrate by having the foam delivery slot of the applicator in sealed contact with the substrate.

Conventionally, the foam is fed from a generator through a delivery conduit to an applicator head at the location of application to the traveling substrate. The foam is a compressable medium, which results in a significant pressure drop between the generator and the delivery slot of the applicator head. In this type of system, during continuous application to a continuously traveling substrate, a uniform thickness of foam can be applied with the foam being delivered at a constant rate and pressure to the substrate passing the applicator head slot at a uniform speed. This is illustrated in FIG. 1. However, under normal mill-operating conditions, there are occasions when the substrate is stopped, which may be for only seconds or may be for minutes or longer. When the substrate stops, the foam delivery must be stopped as well. When this occurs, the pressure differential of the foam within the delivery conduit equalizes, with the pressure at the applicator head being greater than during normal operation and the pressure at the generator end of the conduit being less than the normal delivery pressure from the generator. Thus, when the system is started after such a stop, the higher than normal pressure at the applicator head slot results in a thicker coating delivery due to the higher foam pressure followed by reduction in the coating application as the lower than normal pressure upstream in the conduit further decreases as the foam travels through the conduit to the applicator head slot. As application continues, there is a wave-form fluctuation in the delivery pressure and resulting coating thickness until the system stabilizes in a dynamic condition in which the foam pressure uniformly decreases along the conduit from the generator to the applicator head slot, with a continuous uniform thickness of foam again being applied to the traveling substrate. FIG. 2 illustrates this wave-form fluctuating of coating application along a traveling substrate at startup after the traveling substrate has been stopped. The thickness of the coating C during this initial startup condition can vary from a fraction of the desired coating thickness to a multiple of the desired coating thickness and can extend over a length of, for example, 20 to 30 yards of the substrate. The thickness T of the coating C illustrated in FIG. 2 is exaggerated substantially for clarity of illustration.

This coating application fluctuation at startup is not extreme enough under some coating applications to be of concern, but under some circumstances the variation in coating is unacceptable, resulting in a waste of coating and substrate material that must be discarded before the coated substrate is manufactured into a useable product.

One solution to this problem is to close the applicator head slot and bypass the foam delivery past the applicator head or from the applicator head to discharge into a drain with the system being maintained in its dynamic operating condition during stoppage of the traveling substrate. This, however, creates another problem in the form of waste of the foam material and disposing of the foam under environmental restrictions.

Thus, there is a need for a system that minimizes wasteful coating fluctuations during startup as well as minimizing discharge of unused foam.

SUMMARY OF THE INVENTION

By the present invention, an apparatus is provided for applying a chemical foam to a traveling substrate in a manner that minimizes fluctuation in coating thickness and obviates the waste and resulting environmental problems resulting from stops and starts of a traveling substrate as it travels past the foam applicating apparatus.

In the apparatus of the present invention, air and liquid chemicals are mixed in a foam generator to produce foam that is discharged under pressure. A foam applicator head is disposed with a discharge slot extending transversely with respect to a traveling substrate for discharge of foam therefrom to the substrate. A foam delivery conduit communicates with and extends from the foam generator to the foam applicator head to transport foam from the generator to the applicator head with the dynamic pressure of the foam decreasing as the foam travels through the conduit. A plurality of normally open shut-off valves are spaced along the conduit, dividing it into a sequence of conduit sections. A valve controller is operable to close simultaneously the plurality of valves in response to a stoppage of the traveling substrate to, thereby, seal the foam in each conduit section to maintain a static pressure in each section corresponding to the dynamic pressure of the foam in that section during valve-open transport of foam. The controller is operable to open the valves simultaneously in response to resumption of substrate travel. With this arrangement, there is an equalization of pressure in each section, but the pressures in the sequestial sections decrease from the section closest to the generator to the section closest to the applicator head so that when the valves open and supply of foam resumes, there will be an initial pressure drop between the generator and the applicator head corresponding generally to the dynamic pressure drop during operation. Any minor fluctuations will quickly even out so that the apparatus will resume applying the desired uniform thickness of coating over only a short length of substrate.

At the same time that the valves are closed in the conduit in response to stoppage of the traveling substrate, the slot of the applicator head at the substrate is closed to prevent the remaining foam in the applicator head from being discharged onto the stopped substrate. To avoid deterioration of the foam in the applicator head when the system is stopped, which can cause the development of large bubbles in the foam that adversely affect the initial coating application upon restart, a normally closed by-pass outlet is provided in the applicator head operated by a by-pass discharge valve that opens in response to stoppage of the traveling substrate. Functioning with this by-pass discharge valve for the purpose of maintaining dynamic foam flow through the applicator head during stoppage of the substrate and stoppage of foam flow through the foam conduit, a by-pass conduit is provided for transporting foam from the generator to the applicator head bypassing the valves for continuous transport of foam to the applicator head and out the by-pass discharge outlet during stoppage of the substrate with the applicator head slot closed, thereby maintaining desired foam characteristics in the applicator head for resumption of foam application upon startup of the substrate. The by-pass conduit is substantially smaller in cross-section than the foam conduit so that only a minor portion of the normal quantity of foam is transported through the by-pass conduit. Also, the by-pass conduit is open continuously both during normal operation and during stoppage, with the foam flow through the by-pass conduit combining with the flow through the foam delivery conduit during normal operation to provide the foam being applied to the traveling substrate. In the preferred embodiment, the cross-section of the by-pass conduit relative to the cross-section of the foam delivery conduit results in approximately 10% to 15% of the total flow of foam through both conduits being through the by-pass conduit.

Preferably, the applicator head includes a foam distribution chamber for distributing the foam uniformly from the foam conduit to the applicator head slot when the slot is open.

Preferably a by-pass foam return conduit is provided for communicating between the discharge outlet of the applicator head and the foam generator for return of foam to the generator during stoppage of substrate travel. This avoids waste of the chemicals in the foam as well as avoiding environmental problems were the foam discharged to a drain.

Preferably, the foam return conduit is connected to a settling tank in which the foam deteriorates to a liquid form and is transported therefrom through a liquid return conduit to the foam generator for recycling.

In the preferred embodiment, there are two settling tanks with a settling tank input valve means operable to discharge foam from the foam return conduit to a selected one or the other of the settling tanks. A discharge valve means discharges the liquid material from one of the settling tanks while the other one is being filled. The settling tank input valve means and the discharge valve means are controlled by a valve control responsive to the level of fill in the settling tanks that closes flow to a filled settling tank, opens flow to the other settling tank, closes the flow from that other settling tank and opens flow from the filled tank to a liquid return conduit when the foam has settled to a liquid. A feed pump in the liquid return conduit pumps liquid from the settling tanks to the foam generator.

Other features and variations of the present invention will be apparent from the following detailed description and the accompanying drawings.

DETAILED DESCRIPTION OF PREFERRED EMBODIMENTS

Figure 4:
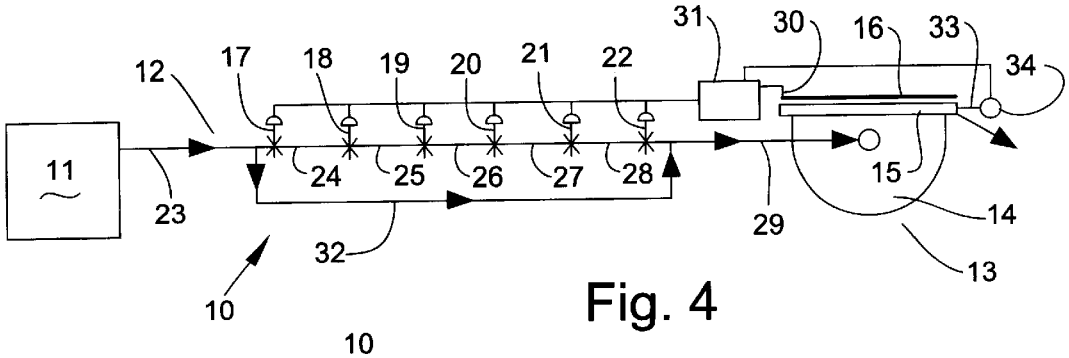
FIG. 4 is a diagramatic illustration of the portion of the apparatus of the preferred embodiment of the present invention that includes the foam generator, the foam delivery conduit, the shut-off valves system and the applicator head.
Figure 5:
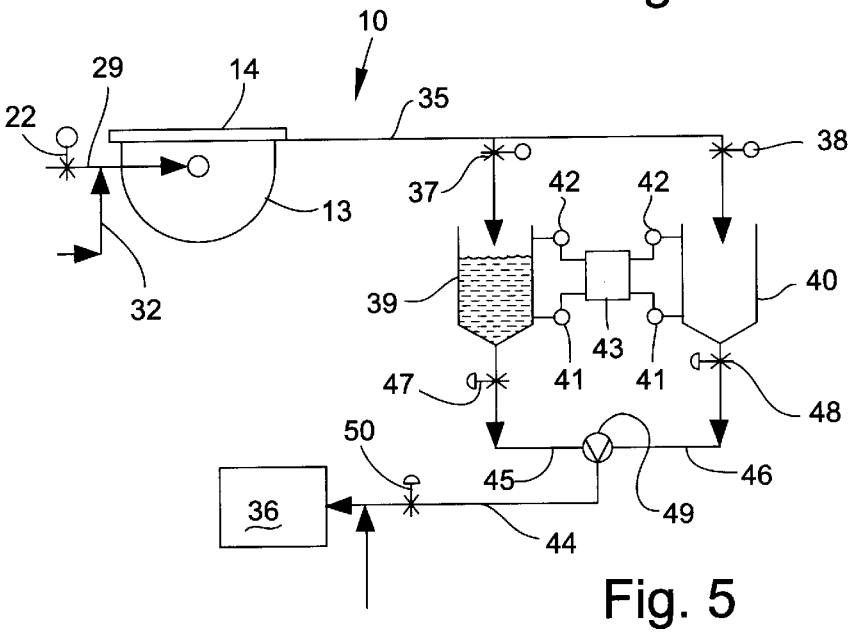
FIG. 5 is a diagramatic of the illustration of another preferred embodiment adding to the embodiment of a portion of the apparatus from the foam applicator back to the foam generator.

Preferred embodiments of the apparatus for applying a chemical foam to a traveling substrate of the present invention are illustrated in FIGS. 4 and 5. As seen in FIG. 4, the apparatus 10 includes a conventional foam generator 11, such as disclosed in U.S. Pat. No. 4,237,818, to which air and a liquid chemical, such as a liquid dyestuff or sizeing or other treating material, is fed for the generation by the generator 11 of a foam material. The foam is transported through a foam conduit 12 to an applicator head 13, which preferably is in the form illustrated in U.S. Pat. No. 4,655,056, having a parabolic distribution chamber 14 in which the foam is distributed uniformly across the length of an applicator head slot 15 that is disposed transversely in contact with a traveling substrate 16 for application of foam thereto in a uniform thickness. The foam is delivered under pressure, with the delivery pressure and flow being controlled conventionally to provide a selected uniform thickness of coating application. For this purpose, the traveling substrate 16 is in pressure resisting contact with the applicator head slot 15 so that the pressurized foam will enter the intersticies of the substrate in the case of a textile fabric or other similarly textured material. The applicator is of the type illustrated and described in my co-pending U.S. patent application Ser. No. 09/175,651 having an inflatable bladder at the slot for closing the slot and a complementary discharge valve that opens when the slot valve is closed for discharge of foam from the applicator head so as to maintain a dynamic flow passage of foam through the applicator head.

Disposed along the length of the foam conduit 12 is a plurality of sequential, normally open shut-off valves 17, 18, 19, 20, 21, and 22. These are generally equally spaced along the length of the foam conduit 22 to divide the conduit into a plurality of conduit sections 23, 24, 25, 26, 27, 28 and 29. The valves are provided to close when the substrate stops traveling. For this purpose, a conventional sensor 30 senses the stoppage of substrate travel and a controller 31, responsive to the sensor, operates the valves 17–22 to simultaneously close all of the valves and, thereby, stop flow of foam through the conduit 12 and isolate the conduit sections 23–29 from each other so that the pressure in each section is generally the same as the dynamic pressure during open valve operation. When the valves close, the pressure in each section is equalized rather than having a pressure drop through the section, but the average pressure drop is substantially the same as the average pressure drop through the section during normal open valve operation. In the embodiment illustrated there are six valves, but the number of valves can be varied depending on the length of the foam conduit and the desired length of the individual conduit sections. The shorter the length of each section, the less the pressure drop through the section such that when the valves are opened the initial pressure at the downstream end of the section will not be appreciably greater than the normal operating pressure and the pressure at the upstream end will not be appreciably less than the normal open valve operating pressure.

When the substrate resumes travel after a stoppage, the controller 31 operates to open all of the valves 17–22 and flow of foam under pressure through the conduit 12 resumes. While there has been an equalization of the pressure drop in each section, the sections are short enough that this has a minimal effect on the delivery pressure of the foam as the foam reaches the applicator head 13 such that during the period of start-up, the pressure drop throughout the conduit 12 and the pressure at the applicator head 13 is substantially the same during normal running conditions.

Figure 1:
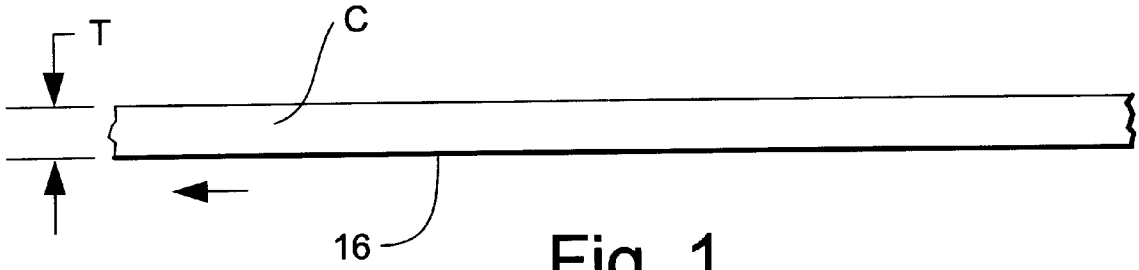
FIG. 1 is a diagramatic representation of the uniform thickness coating application applied by a foam applying apparatus during continuous operation of foam application to a traveling substrate.
Figure 2:
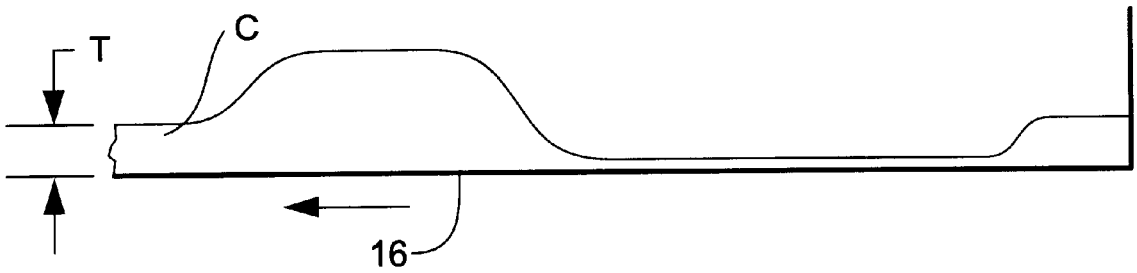
FIG. 2 is a diagramatic representation of the coating application to a traveling substrate immediately after startup following a stoppage of the traveling substrate when using foam applying systems that do not incorporate the present invention.
Figure 3:
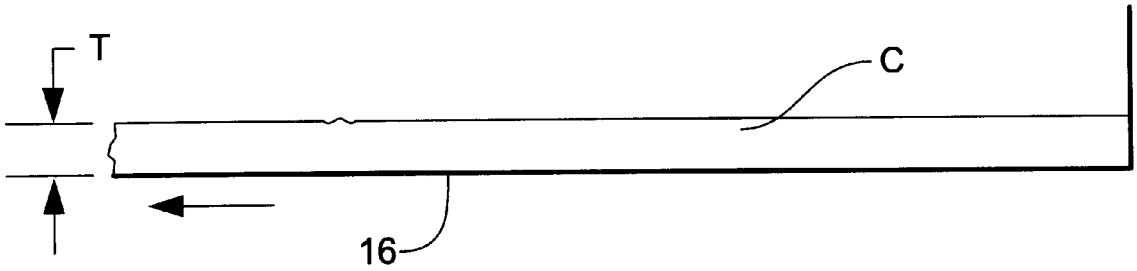
FIG. 3 is a diagramatic representation of the coating application to a traveling substrate immediately after startup following a stoppage of the traveling substrate when using the apparatus of the preferred embodiment of the present invention.

Without the present invention, the coating application varies during start-up for an appreciable extent and in an appreciable amount. As illustrated in FIG. 2, the coating may fluctuate between half to twice normal thickness and over an extended length that may be as much as 20 to 30 yards, resulting in that much waste of substrate and treating material. In contrast, as illustrated in FIG. 3, the apparatus 10 of the present invention results in a minimal fluctuation and that fluctuation only extending over a very short length of substrate, as little as one or two feet.

To avoid stagnation and deterioration of the foam in the applicator head 13 when the conduit valves 17–22 are closed, the present invention provides a by-pass conduit 32 communicating with the foam delivery conduit 12 upstream of the first conduit valve 17 and downstream of the last conduit valve 22. This bypass conduit 32 is relatively small in cross-section in comparison with the foam delivery conduit 12. The foam delivery conduit 12 may, for example, be one and one-half inches in diameter and the by-pass conduit 32 is of a size that during normal open valve operation only approximately 10–15% of the foam flow will pass through the by-pass conduit. It is only necessary that the by-pass conduit 32 be of a size sufficient to deliver enough foam to the applicator head 13 to prevent stagnation of foam in the applicator head 13. A discharge outlet 33 is provided in the applicator head 13 and has a discharge valve disposed thereat and openable under control of the controller 31 in response to stoppage of the traveling substrate to discharge foam from the applicator head 13 as foam is being fed to the applicator head through the by-pass conduit 32, thereby maintaining a dynamic foam condition in the applicator head 13.

Figure 6:
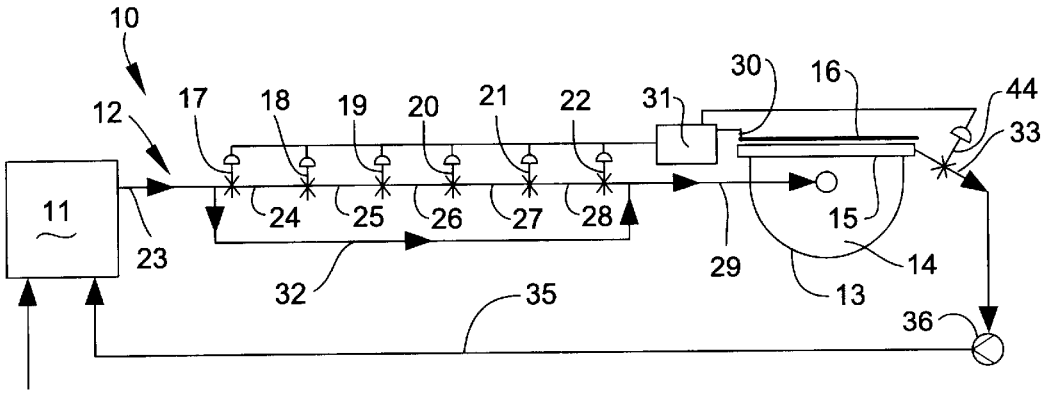
FIG. 6 is a diagramatic illustration of an alternative form of the present invention in which foam discharged from the applicator head is returned directly to the foam generator.

The foam passing through the discharge valve 34 may be discharged to a drain as illustrated in FIG. 4. However, it is preferable to recycle the discharged foam. For this purpose in a simplified embodiment of the present invention illustrated in FIG. 6, a foam return conduit 35 is disposed communicating between the by-pass discharge outlet 33 and the foam generator 11, with a pump 36 disposed in the return conduit 35 for pumping the discharged foam from the applicator head 13 to the generator 11. In this embodiment, the discharged foam is in a foamed condition when it returns to the generator and can be recycled, with the addition of whatever small amount of air and liquid chemical may be necessary to maintain the desired condition of the foam that is exiting the generator 11.

Preferably, the foam is not recycled to the generator 11 in a foamed condition. Rather, the foam is freshly generated in the generator 11 so that proper control of the foam production can be obtained without any problem in the condition of the foam that would otherwise be returned to the generator from the applicator head 13. In this embodiment, as illustrated in FIG. 5, the return conduit 35 communicates with a pair of oppositely open and closed valves 37 and 38. Each of these valves 37 and 38 open into the top of a respective open settling tank 39 and 40. Thus, when the first valve 37 is opened to the first settling tank 39, the discharge foam will flow into that settling tank 39. During this time, the second valve 38 of the pair is closed so that there is no flow into its settling tank 40. Each of the tanks 39 and 40 has a lower level sensor 41 and an upper level sensor 42 to sense the level of foam in the settling tank. A conventional tank controller 43 is connected to the sensors 41 and 42 for opening and closing of the settling tank valves 37 and 38. Thus, as foam is being discharged through one open settling tank valve 37 into the associated settling tank 39, with the other settling tank valve 38 being closed and the level of foam in the first settling tank 39 rises and reaches the level of the upper level sensor 42, the tank controller 43 will close the first settling tank valve 37 to discontinue discharge of foam into the respective settling tank 39 and the controller 43 will open the second settling tank valve 31 to begin discharge of foam into the second settling tank 40. The foam in the settling tanks settle to a liquid. A liquid return conduit 44 communicates between the settling tanks 39, 40 and the foam generator 11 and has a component 45 and 46 connected to each of the settling tanks 39 and 40 with liquid return valves 47 and 48 in each of the conduit components 45 and 46. These valves 47 and 48 remain closed until the foam in a respective settling tank 39 and 40 has degenerated from foam to a liquid and is in condition for return to the generator 11. These return valves 47 and 48 may be timed or may be controlled by the tank controller 43 or may be manually manipulated depending on the circumstances. Included in the liquid return conduit 44 is a pump 49 to which the components 45 and 46 of the liquid return conduit 44 communicate. This return pump 49 serves to pump the liquid through the return conduit 44 to the generator 11. Between the pump 49 and the generator 11 is a shut-off valve 50 that may be manually operated or automatically operated in response to the filling conditions of the settling tanks 39 and 40 to stop flow of recirculating liquid from the settling tanks to the generator.

With the apparatus of the preferred embodiment illustrated in FIGS. 4 and 5, in the normal operating condition foam produced by the generator 11 is transported through the foam delivery conduit 12 and by-pass conduit 32 to the applicator head 13 in which the foam is uniformly distributed by the distribution chamber 14 and passes through the applicator head slot 15 to the traveling substrate 16 to apply a uniform thickness of foam. In this normal operating condition, the discharge valve 34 is closed so that all of the foam is delivered through the applicator head slot 15 and none is either recirculated or discharged to a drain.

When the substrate 16 stops, the substrate sensor 30 senses the stoppage and sends a signal to the controller 31 which then simultaneously closes all of the foam conduit valves 17–22, stopping flow and maintaining the existing pressure in each of the conduit sections 23–29 while foam continues to flow through the by-pass conduit 32 into the applicator head 13. The controller 31 also opens the discharge valve 34 to allow discharge of foam from the applicator head and, thereby, maintain dynamic conditions in the applicator head 13. The discharging foam is transported through the return conduit 35 and through the open one of the two settling tank valves 37 and 38 into the respective settling tank 39 or 40. When the substrate sensor 30 senses that the substrate has resumed travel, it sends a signal to the controller 31, which operates to simultaneously open the valves 17–22 and the applicator head slot 15 while closing the by-pass discharge valve 34, thereby recreating the normal operating condition for applying uniform thickness foam to the traveling substrate 16.

During substrate stoppage when the foam is passing through the return conduit 35, the settling tank to which the foam is being discharged will begin to fill the tank. Full filling of the tank may occur during one or several stoppage cycles, but in any event when the foam rises to the level of the upper level sensor 42 of the respective tank, the tank controller 43 will switch the settling tank valves 37 and 38 to start filling the other settling tank. When the foam in the full settling tank has decomposed to a liquid, the respective return valve 47 will be opened and the return pump 49 activated and the shut-off valve 50 opened to discharge the settled liquid back into the foam generator 11 for regeneration and circulation of the foam.

When the apparatus is returned to normal foam application to the traveling substrate, the discharge valve 34 from the discharge outlet 33 of the applicator head 13 is closed, the pump 36 is deactivated and the shut-off valve 50 is closed, thereby shutting down the recirculation portion of the apparatus.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. Apparatus for applying a chemical foam to a traveling substrate, comprising:

a foam generator in which air and liquid chemicals are mixed and discharged in the form of a foam under pressure, a foam applicator head disposed with a discharge slot extending transversely with respect to the traveling substrate for discharge of foam therefrom to the substrate, a foam delivery conduit communicating with and extending from said foam generator to said applicator head to transport foam from said foam generator to said applicator head with the dynamic pressure of the foam decreasing as the foam travels through said conduit, a plurality of normally open shut-off valves spaced along said conduit dividing said conduit into a sequence of conduit sections, a valve controller operable to close simultaneously said of valves in response to a stoppage of the traveling substrate to seal the foam in said conduit sections to maintain a static pressure in each section corresponding to the dynamic pressure of the foam in each said conduit section during said valves open transport of the foam, said controller being operable to open said valves simultaneously in response to resumption of substrate travel.

2. The apparatus for applying a chemical foam to a traveling substrate according to claim 1 and characterized further in that said applicator head slot is disposed in sufficient proximity to the traveling substrate to result in the foam being under pressure as it is discharged to the substrate.

3. The apparatus for applying a chemical foam to a traveling substrate according to claim 2 and characterized further by a by-pass conduit communicating with said generator and said applicator head and bypassing said valves for continuous transport of the foam from said foam generator to said applicator head, a slot closure valve operable upon stoppage of the traveling substrate to close said applicator head slot to prevent foam discharge to the substrate, a discharge outlet in said applicator head, and a discharge valve at said discharge outlet operable in response to stoppage of the traveling substrate to discharge from said applicator head foam being transported to said applicator head through said by-pass conduit, thereby maintaining a dynamic foam condition in said applicator head.

4. The apparatus for applying a chemical foam to a traveling substrate according to claim 3 and characterized further in that said applicator head includes a foam distribution chamber for distributing the foam uniformly from said conduit to said applicator head slot when said applicator head slot is open.

5. The apparatus for applying a chemical foam to a traveling substrate according to claim 3 and characterized further in that said by-pass conduit is substantially smaller in cross-section than said conduit.

6. The apparatus for applying a chemical foam to a traveling substrate according to claim 5 and characterized further in that the relative cross-sections of said conduits results in flow of foam through said by-pas conduit of approximately 10% to 15% of the total flow of foam through both conduits when said valves are open.

7. The apparatus for applying a chemical foam to a traveling substrate according to claim 3 and characterized further by a foam return conduit communicating between said discharge outlet and said foam generator for return of the foam to said foam generator.

8. The apparatus for applying a chemical foam to a traveling substrate according to claim 3 and characterized further by a settling tank, a foam return conduit communicating between said discharge outlet and said settling tank for discharge of foam into said settling tank, and a liquid return conduit communicating between said settling tank and said foam generator.

9. The apparatus for applying a chemical foam to a traveling substrate according to claim 3 and characterized further by a plurality of settling tanks, a foam return conduit communicating with said discharge outlet, settling tank input valves in said foam return conduit operable selectively to open for flow therethrough to selected one or another of said plurality of settling tanks, settling tank discharge valves communicating with each settling tank, a liquid return conduit communicating between said settling tank discharge valves and said foam generator, a control responsive to the level of fill in each of said settling tanks to manipulate said settling tank input and discharge valves to close flow to a filled settling tank and open flow to another settling tank and to open the filled settling tank to said liquid return conduit when the foam has settled to a liquid.

10. The apparatus for applying a chemical foam to a traveling substrate according to claim 9 and characterized further by a foam return pump between said liquid return conduit and said foam generator to pump the liquid from said settling tanks to said foam generator.

11. The apparatus for applying a chemical foam to a traveling substrate according to claim 3 and characterized further by a pair of settling tanks, a return conduit communicating with said discharge outlet, a settling tank input valve means in said return conduit operable to alternately open for flow therethrough to one or the other of said pair of settling tanks, a settling tank discharge valve means communicating with each settling tank, a liquid return conduit communicating between said settling tank discharge valve means and said foam generator, said input and discharge valve means including a valve control responsive to the level of fill in each of said settling tanks to close flow to a filled settling tank, open flow to the other settling tank, close flow from the other settling tank and open flow from the filled settling tank.

12. The apparatus for applying a chemical foam to a traveling substrate according to claim 11 and characterized further by a foam return pump between said liquid return conduit and said foam generator to pump liquid from said settling tanks to said foam generator.

* * * * *